US011090792B2

(12) United States Patent
Wang

(10) Patent No.: US 11,090,792 B2
(45) Date of Patent: Aug. 17, 2021

(54) STAPLE GUN

(71) Applicant: APEX MFG. CO., LTD., Taichung (TW)

(72) Inventor: Jing-Li Wang, Taichung (TW)

(73) Assignee: APEX MFG. CO., LTD., Taichung (TW)

( * ) Notice: Subject to any disclaimer, the term of this patent is extended or adjusted under 35 U.S.C. 154(b) by 251 days.

(21) Appl. No.: 16/504,588

(22) Filed: Jul. 8, 2019

(65) Prior Publication Data

US 2021/0008702 A1 Jan. 14, 2021

(51) Int. Cl.
*B25C 5/11* (2006.01)
*B25C 5/06* (2006.01)

(52) U.S. Cl.
CPC . *B25C 5/11* (2013.01); *B25C 5/06* (2013.01)

(58) Field of Classification Search
CPC .... B25C 5/06; B25C 5/00; B25C 5/02; B25C 5/11–15; B25C 5/1624; B25C 5/1658; B25C 5/1679
USPC ..... 227/107, 108, 120, 139
See application file for complete search history.

(56) References Cited

U.S. PATENT DOCUMENTS

2014/0231486 A1* 8/2014 Burch ..... B25C 5/0285 227/63
2015/0041516 A1* 2/2015 Chen ..... B25C 5/11 227/107
2016/0303726 A1* 10/2016 Hu ..... B25C 5/1606

FOREIGN PATENT DOCUMENTS

TW I513555 B 12/2015

* cited by examiner

*Primary Examiner* — Anna K Kinsaul
*Assistant Examiner* — Veronica Martin
(74) *Attorney, Agent, or Firm* — Muncy, Geissler, Olds & Lowe, P.C.

(57) ABSTRACT

A staple gun includes a housing, a striking member, a force-accumulating assembly, a driving mechanism and an adjusting mechanism. The housing includes a staple outlet. The strike member is disposed on the housing. The force-accumulating assembly is movably disposed on the housing and engaged with the striking member. The force-accumulating assembly includes two accumulating members. The driving mechanism includes a pressing lever which is rotatably disposed on the housing and an engaging portion. The adjusting mechanism is disposed on the housing and assembled with the force-accumulating assembly.

10 Claims, 9 Drawing Sheets

STAPLE GUN

BACKGROUND OF THE INVENTION

Field of the Invention

The present invention relates to a staple gun.

Description of the Prior Art

A conventional staple gun includes a housing, an elastic plate, a pressing lever, a hooked member and a striking board which are disposed on the housing, and the striking board is assembled with the elastic plate and the hooked member. When the pressing lever is pressed, the pressing lever drives the elastic plate to deform, and the hooked member restricts the striking board from striking toward a staple outlet of the housing to accumulate force. When the pressing lever is pressed to a striking position, the pressing lever drives the hooked member to disengage from the striking board, and the striking board is driven by the elastic plate and strikes toward the staple outlet. This type of staple gun is disclosed in Taiwan Patent Number 1513555.

Striking strength of the striking board depends on a moving path of the striking board and an elastic coefficient and deformation of the elastic plate; however, the striking strength of the conventional staple gun is fixed. The conventional staple gun staples with a fixed striking strength no matter to hard or soft objects, which is inconvenient to use. Therefore, a staple gun with adjustable striking strength is provided, and the striking strength of the staple gun can be adjusted by changing a position of a force applying point that drives the elastic plate to deform. However, the adjustment of the striking strength is only 10% to 30%, which is not effective enough. As a result, staple guns with different striking strength are required for objects with different properties, which is inconvenient to storage and high cost.

The present invention is, therefore, arisen to obviate or at least mitigate the above-mentioned disadvantages.

SUMMARY OF THE INVENTION

The main object of the present invention is to provide a staple gun, wherein striking strength of a striking member of the staple gun is adjustable according to material and thickness of an object to be stapled or dimensions of staples to be used.

To achieve the above and other objects, the present invention provides a staple gun, including a housing, a striking member, a force-accumulating assembly, a driving mechanism and an adjusting mechanism. The housing includes a staple outlet. The striking member is disposed on the housing and movable toward or away from the staple outlet. The force-accumulating assembly is movably disposed on the housing and engaged with the striking member. The force-accumulating assembly includes two accumulating members. The driving mechanism includes a pressing lever which is rotatably disposed on the housing and an engaging portion, and the pressing lever is swingable between a first position and a second position. The engaging portion and the striking member are engaged with each other when the pressing lever is in the first position; the driving mechanism forces the force-accumulating assembly to deform and accumulate force when the pressing lever is swinging toward the second position; the engaging portion and the striking member are disengaged from each other and the striking member is driven by the force-accumulating assembly and moved toward the staple outlet when the pressing lever is in the second position. The adjusting mechanism is disposed on the housing and movable between a third position and a fourth position, and the adjusting mechanism is assembled with the force-accumulating assembly. When the adjusting mechanism is in the third position, only one of the two accumulating members is engaged and comovable with the striking member; when the adjusting mechanism is moved to the fourth position, the adjusting mechanism drives the force-accumulating assembly to move and both of the two accumulating members are engaged and comovable with the striking member.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
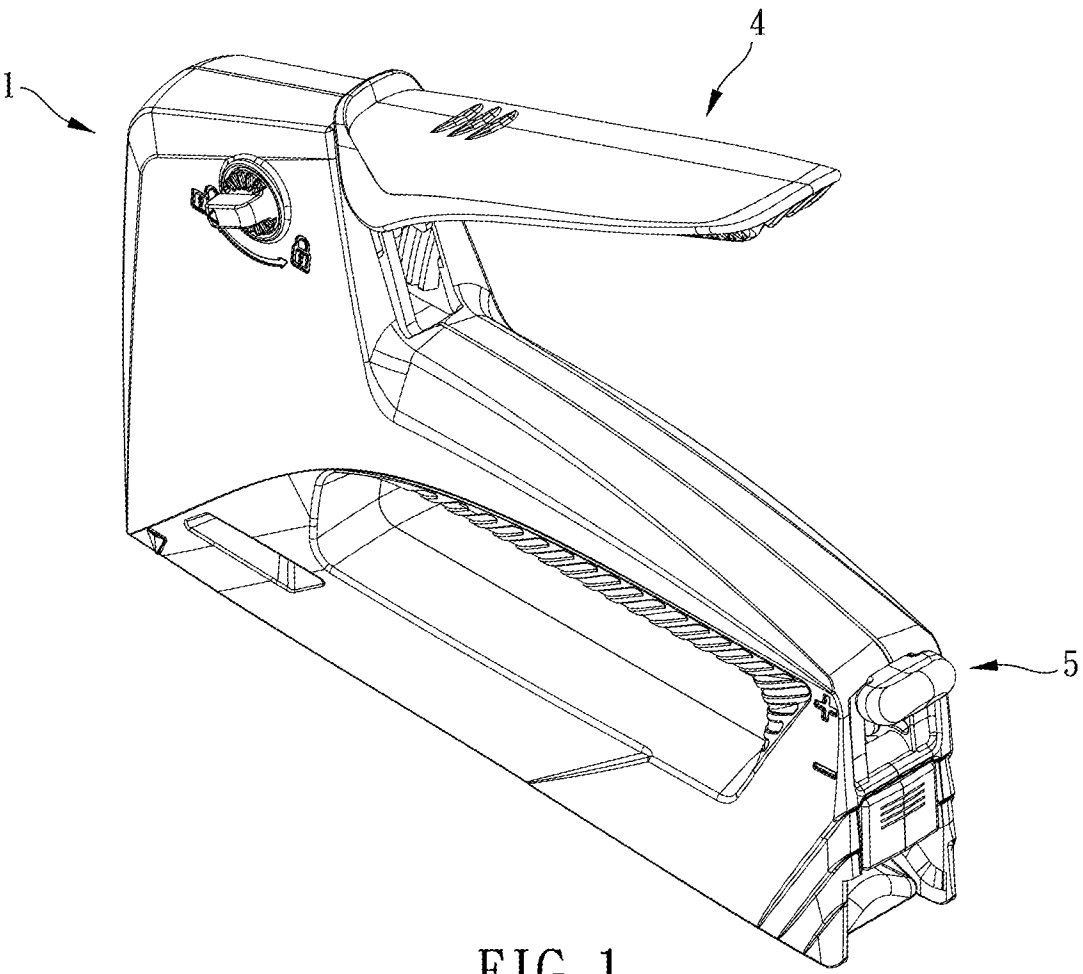
FIG. 1 is a stereogram of a preferable embodiment of the present invention.
Figure 2:
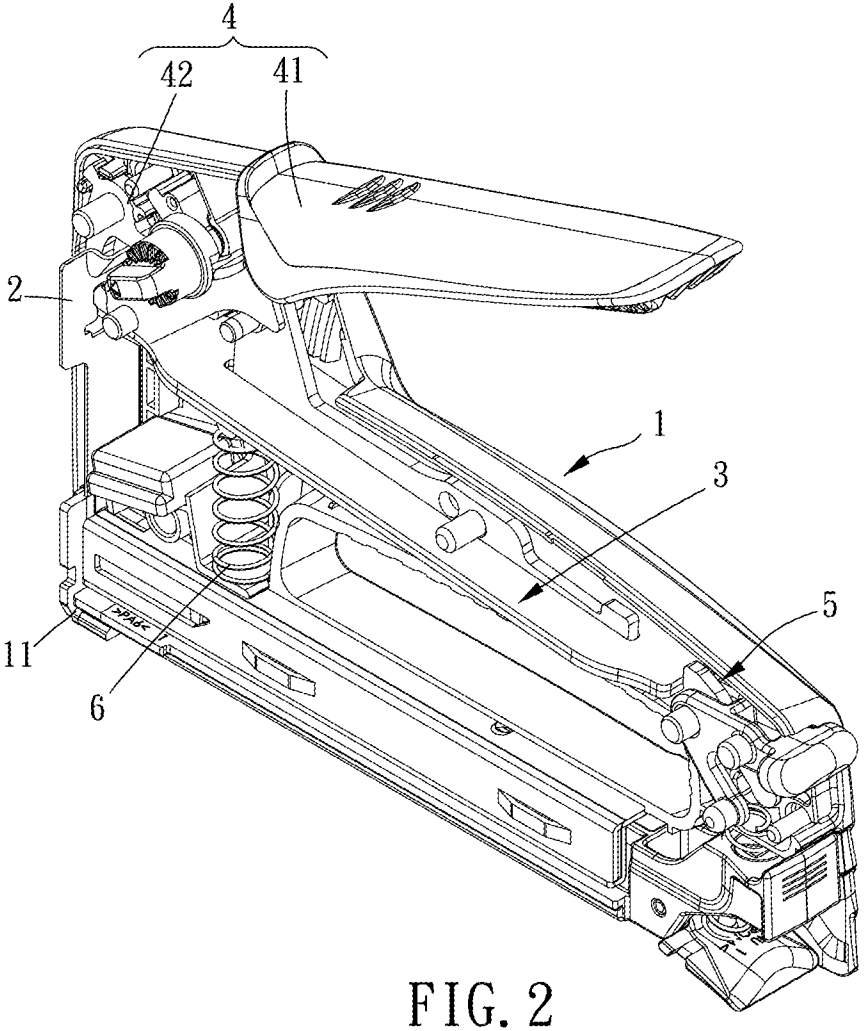
FIG. 2 is a partial breakdown drawing of a preferable embodiment of the present invention.
Figure 3:
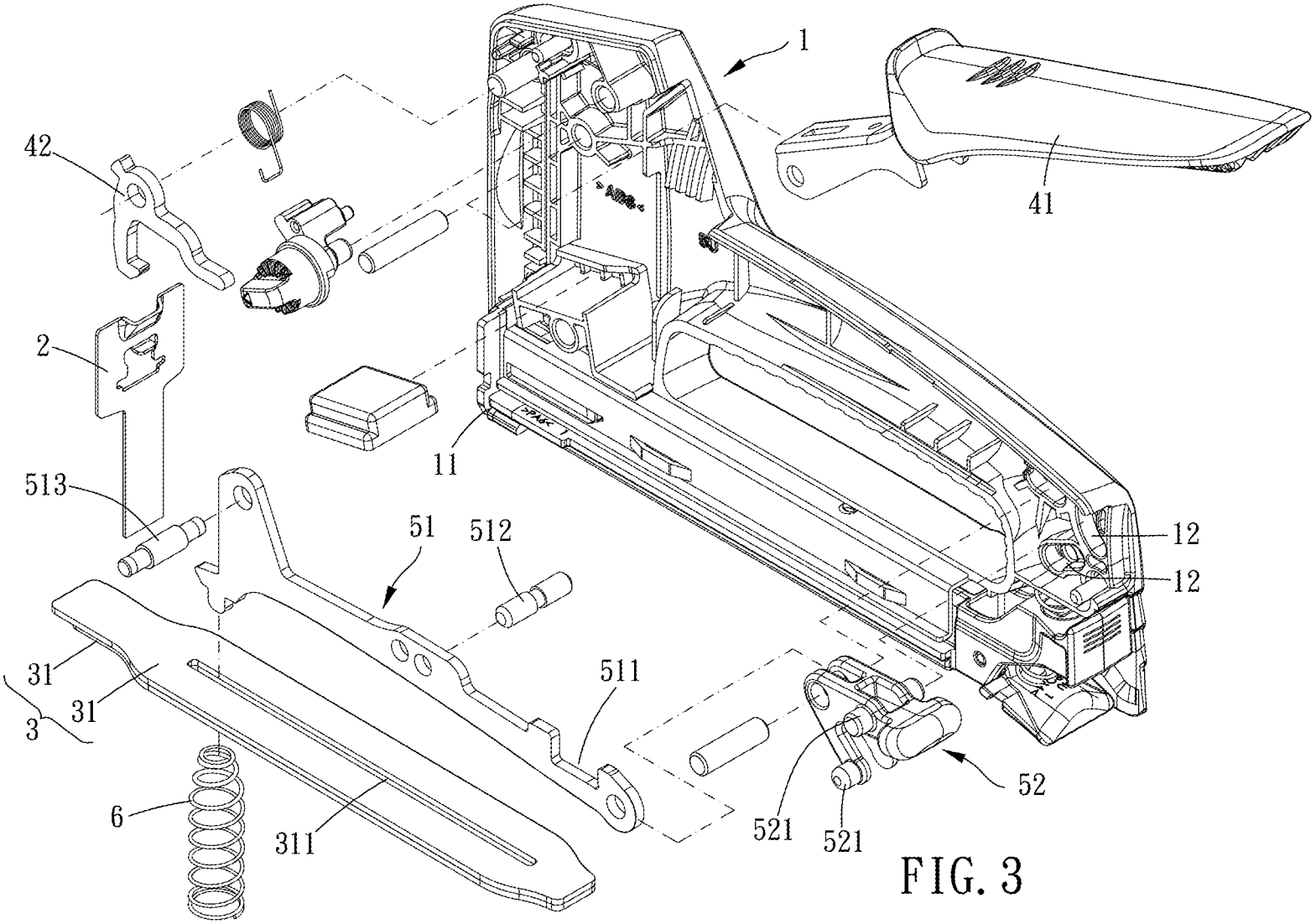
FIG. 3 is a breakdown drawing of a preferable embodiment of the present invention.

Please refer to FIGS. 1 to 9 for a preferable embodiment of the present invention. A staple gun of the present invention includes a housing 1, a striking member 2, a force-accumulating assembly 3, a driving mechanism 4 and an adjusting mechanism 5.

The housing 1 includes a staple outlet 11.

The striking member 2 is disposed on the housing 1 and movable toward or away from the staple outlet 11.

The force-accumulating assembly 3 is movably disposed on the housing 1 and engaged with the striking member 2, and the force-accumulating assembly 3 includes two accumulating members 31.

The driving mechanism 4 includes a pressing lever 41 which is rotatably disposed on the housing 1 and an engaging portion 42, and the pressing lever 41 is swingable between a first position and a second position. The engaging portion 42 and the striking member 2 are engaged with each other when the pressing lever 41 is in the first position (in this embodiment, the engaging portion 42 is hooked within the striking member 2); the driving mechanism 4 forces the force-accumulating assembly 3 to deform and accumulate force when the pressing lever 41 is swinging toward the second position; when the pressing lever 41 is in the second position, the engaging portion 42 and the striking member 2 are disengaged from each other and the striking member 2 is driven by the force-accumulating assembly 3 and moved toward the staple outlet 11 so as to strike the staple located at the staple outlet 11.

The adjusting mechanism 5 is disposed on the housing 1 and movable between a third position and a fourth position, and the adjusting mechanism 5 is assembled with the force-accumulating assembly 3.

Figure 4:
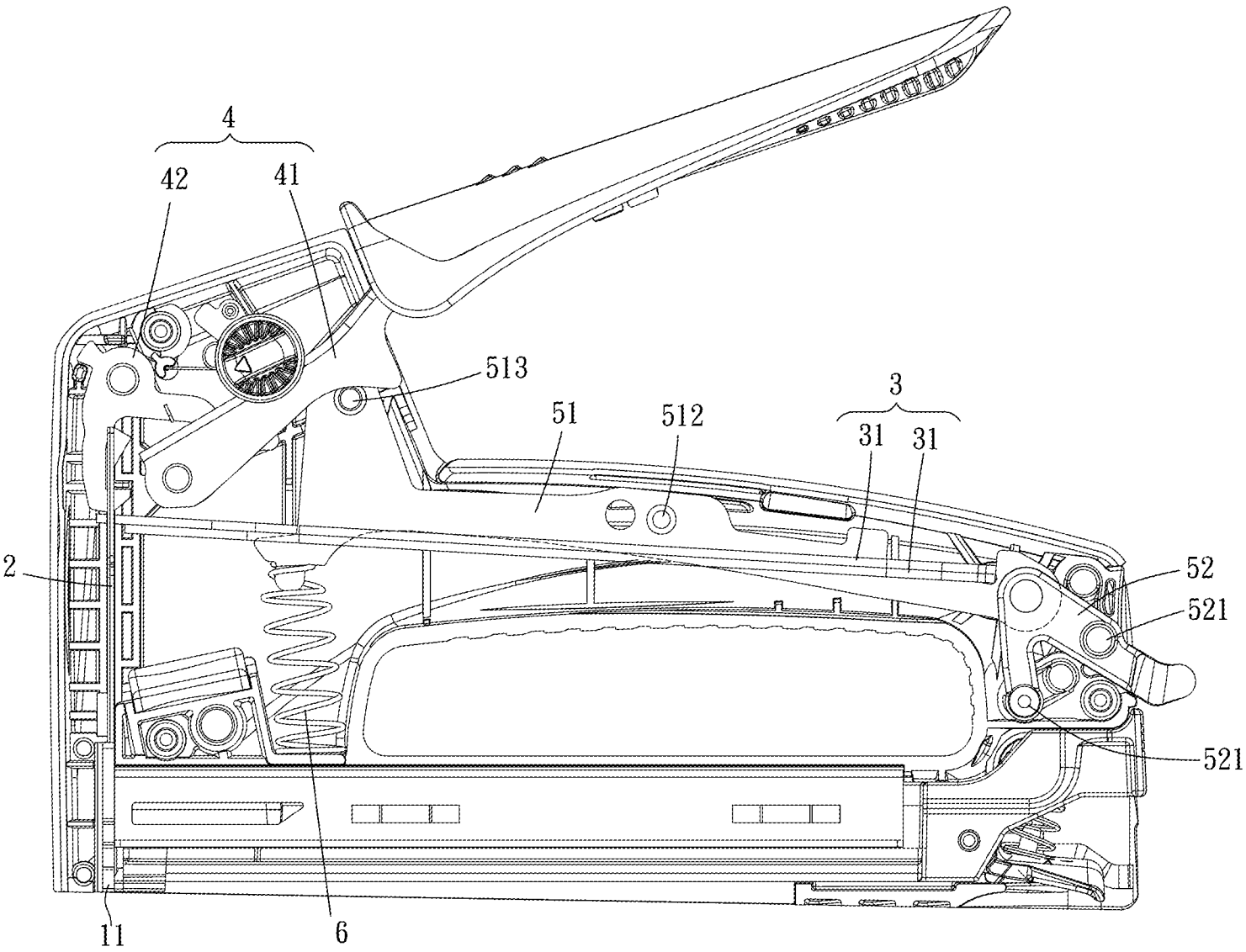
FIGS. 4 and 6 are operational diagrams of a preferable embodiment of the present invention when an adjusting mechanism is in a third position.
Figure 5:
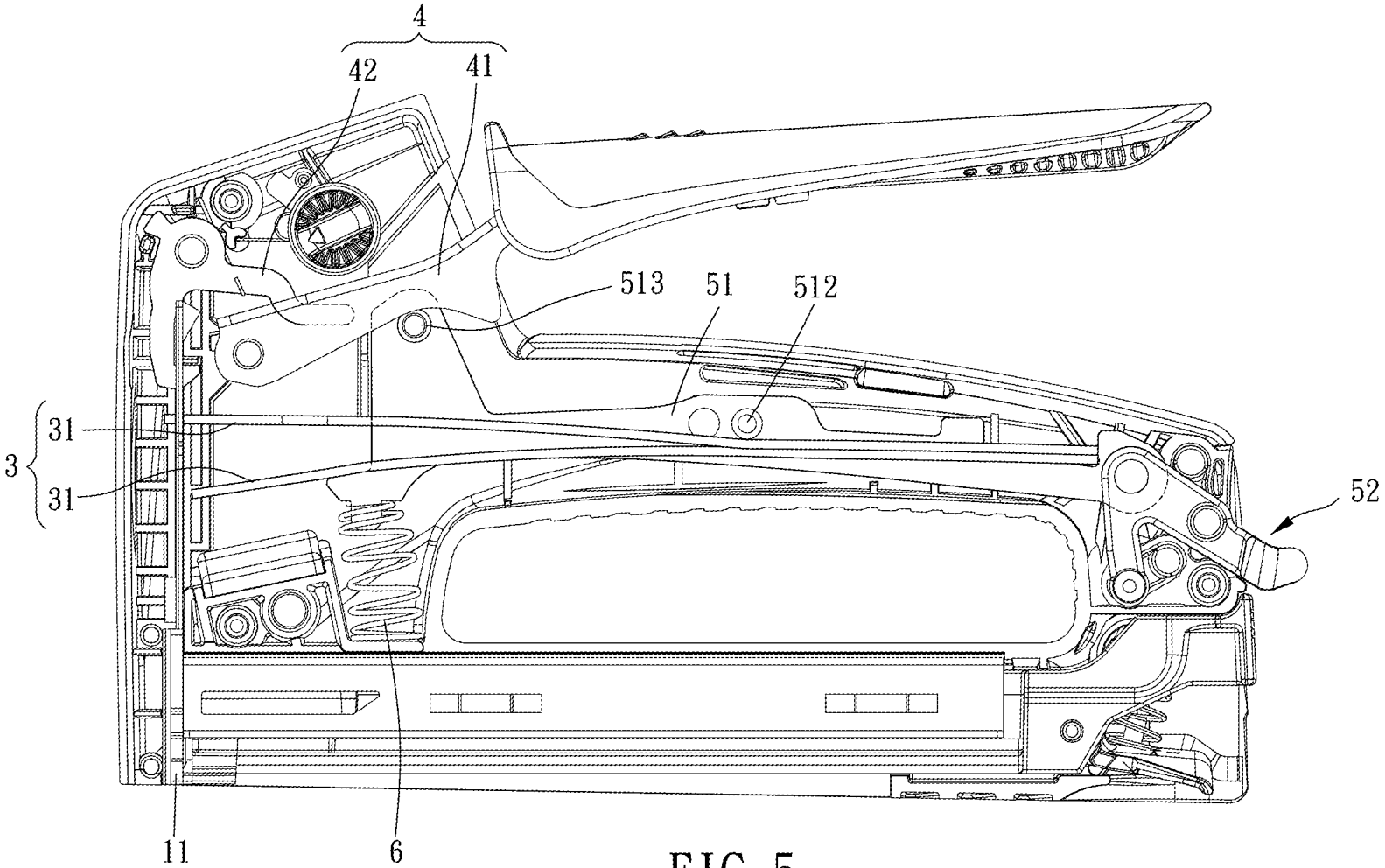
Figure 6:
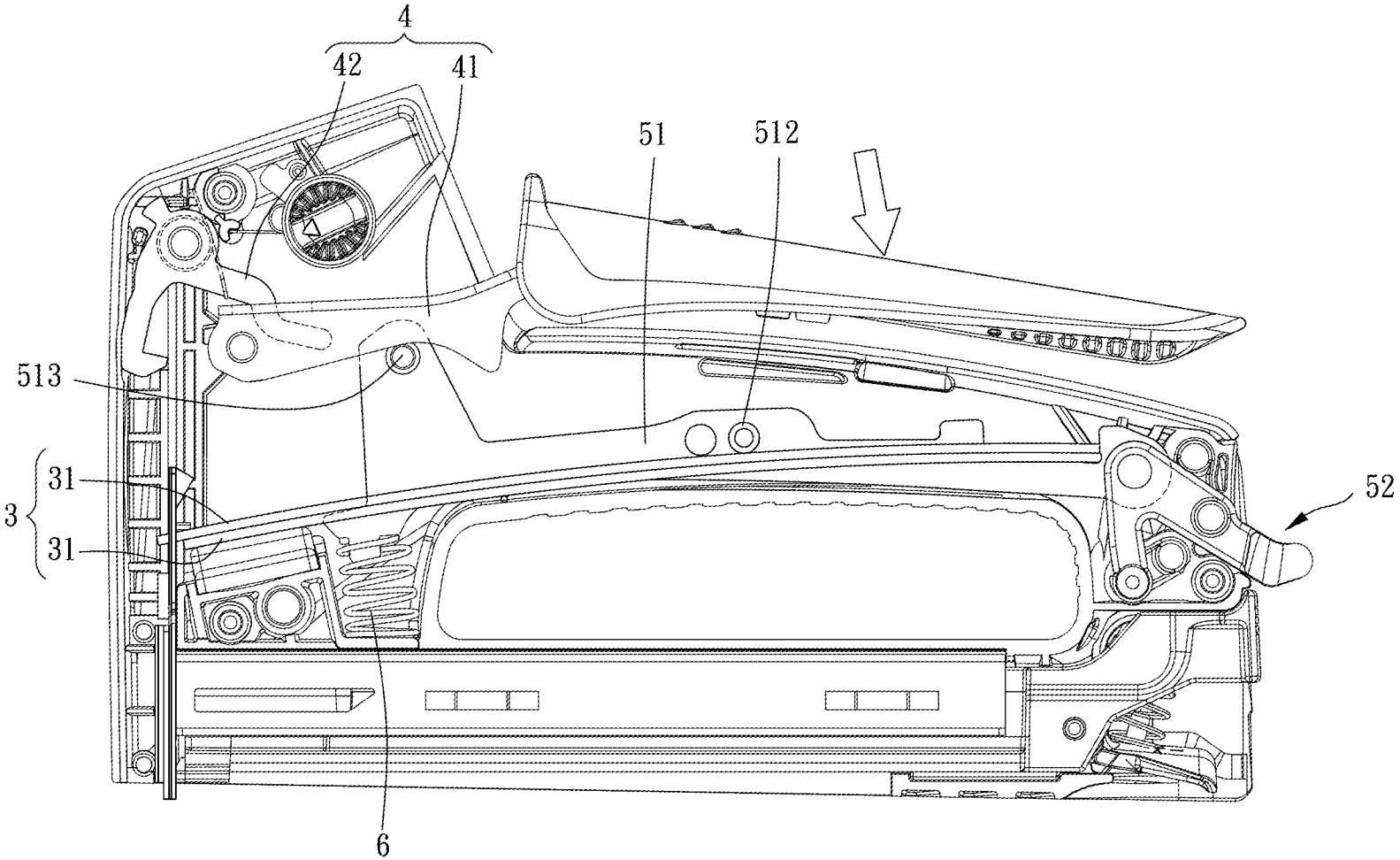
Figure 7:
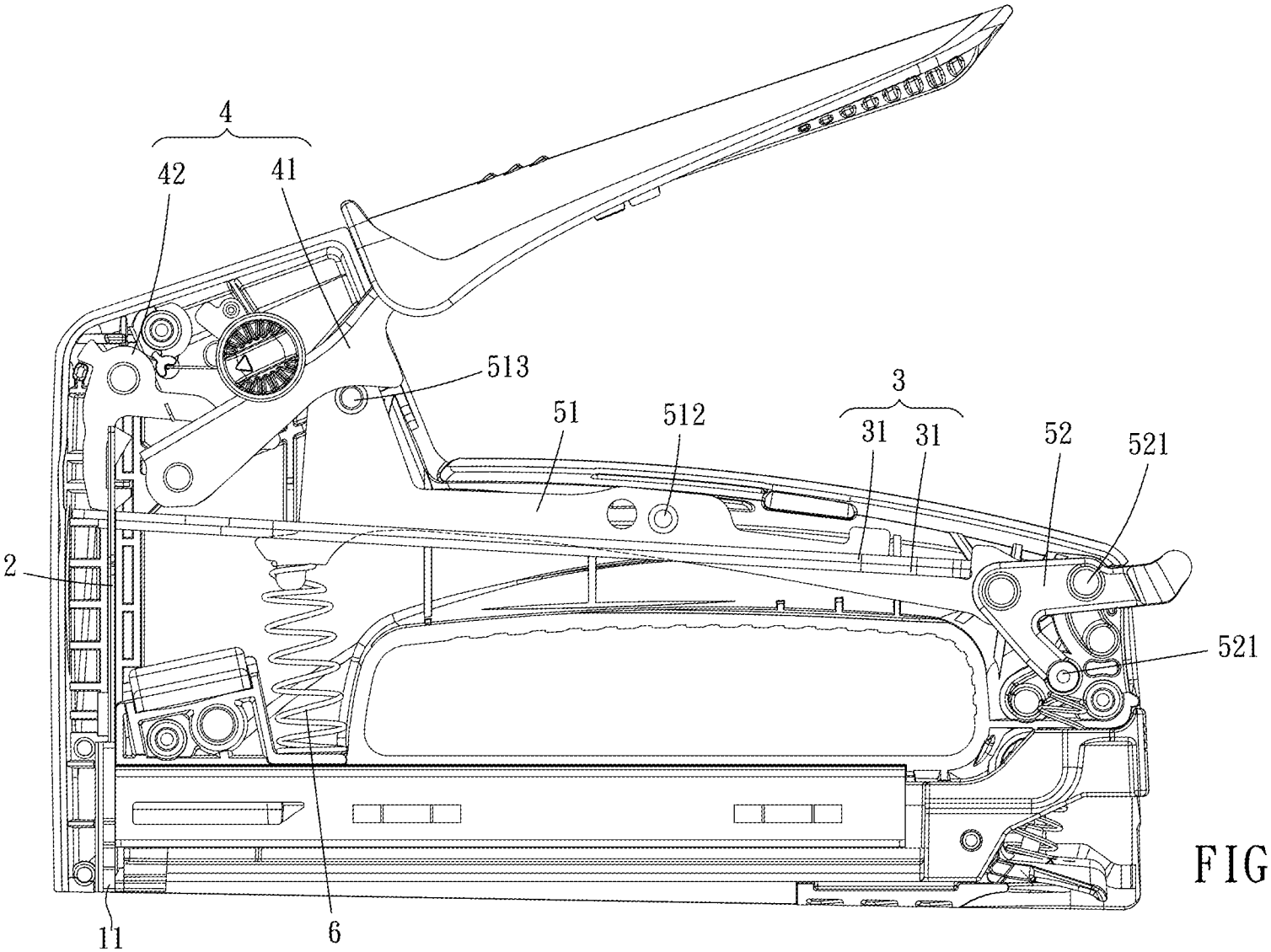
FIGS. 7 and 9 are operational diagrams of a preferable embodiment of the present invention when the adjusting mechanism is in a fourth position.
Figure 8:
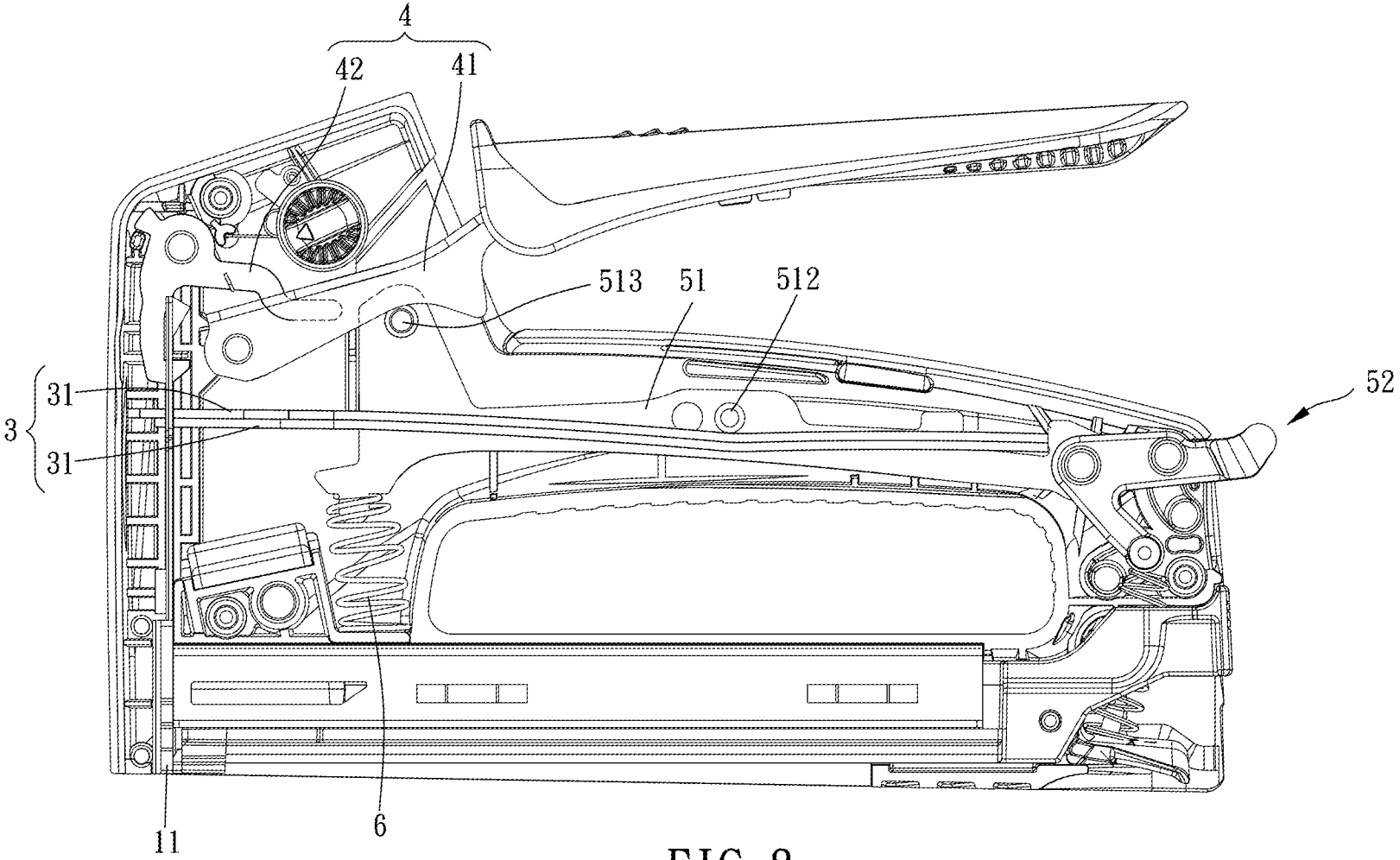
Figure 9:
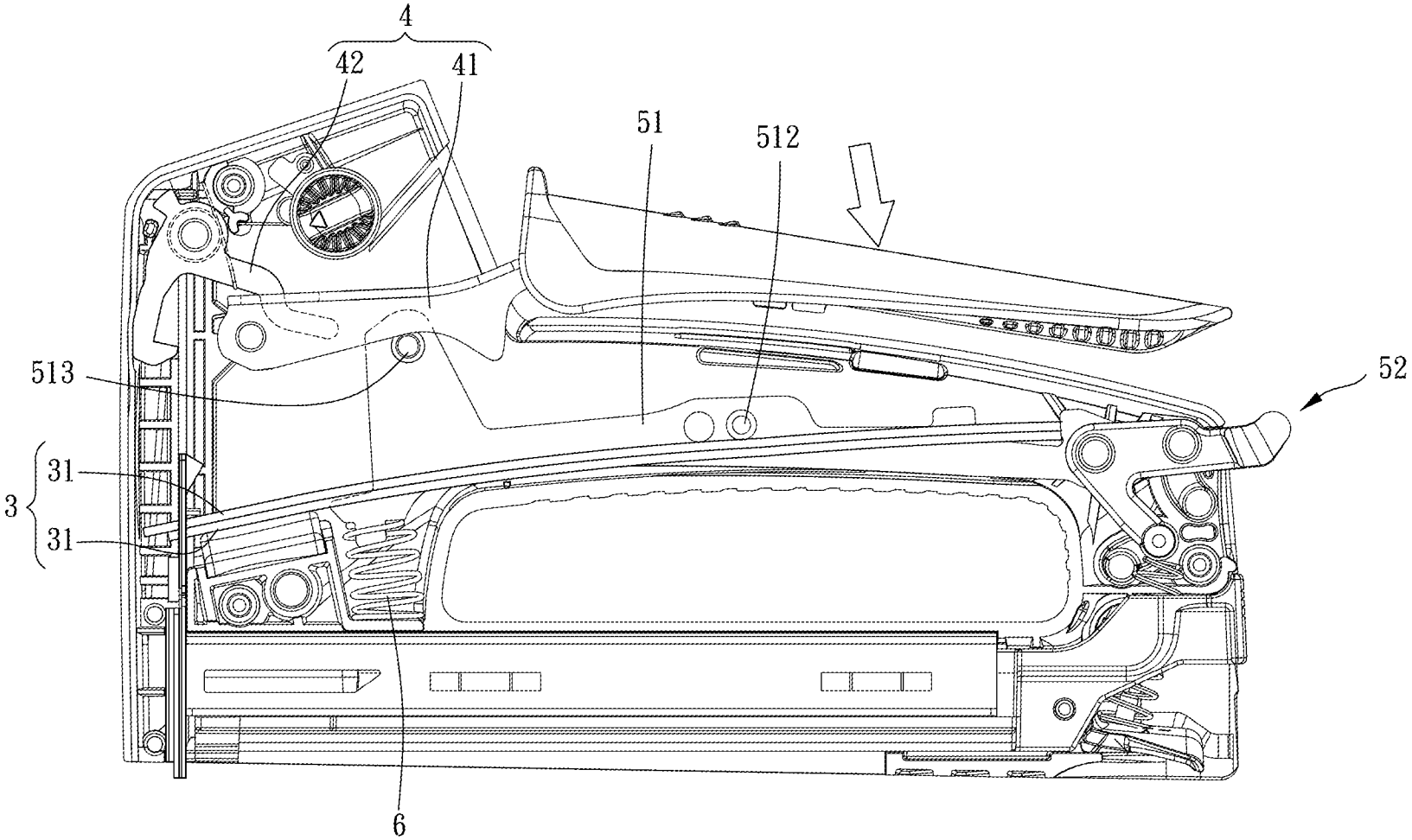

When the adjusting mechanism 5 is in the third position, only one of the two accumulating members 31 is engaged and comovable with the striking member 2; when the adjusting mechanism 5 is moved to the fourth position, the adjusting mechanism 5 drives the force-accumulating assembly 3 to move and both of the two accumulating members 31 are engaged with the striking member 2. In this embodiment, the two accumulating members 31 are inserted within the striking member 2. Therefore, when the adjusting mechanism 5 is in the third position (as shown in FIGS. 4 to 6), the pressing lever 41 is easy to be operated and a smaller striking strength is produced since only one of the two accumulating members 31 is deformed to accumulate force. When the adjusting mechanism 5 is move to the fourth position (as shown in FIGS. 7 to 9), the pressing lever 41 has to be pressed harder and a larger striking strength is produced since both of the two accumulating members 31 are deformed to accumulate force. The striking strength is adjustable by the adjusting mechanism 5 according to various operational requirements, which is convenient to use.

Specifically, the adjusting mechanism 5 includes an actuating member 51, and the actuating member 51 is engaged with the two accumulating members 31. When the adjusting mechanism 5 is moved from the third position toward the fourth position, the actuating member 51 drives both of the two accumulating members 31 to engaged with the striking member 2. Moreover, the adjusting mechanism 5 includes an adjusting member 52, and the adjusting member 52 and the actuating member 51 are assembled with each other. The adjusting member 52 is disposed on the housing 1 and swingable between the third position and the fourth position, and the adjusting member 52 drives the actuating member 51 to move. In this embodiment, the housing 1 includes two sliding grooves 12 which are nonparallel with each other, and the adjusting member 52 is V-shaped and two opposite sides of the adjusting member 52 respectively have a guiding portions 521 (such as projections) which is slidable within one of the two sliding grooves 12. An end of the adjusting member 52 protrudes beyond the housing 1 for easy operation. The actuating member 51 is rotatably connected with the adjusting member 52 so that the actuating member 51 and the adjusting member 52 are comovable.

Preferably, the two accumulating members 31 are overlapped with each other and have respective slots 311 corresponding to each other, and the actuating member 51 penetrates through the respective slots 311 of the two accumulating members 31. An end of the actuating member 51 away from the striking member 2 includes an embedding portion 511 engaged with respective ends of the two accumulating members 31 away from the striking member 2 so as to drive the two accumulating members 31. The actuating member 51 includes a pressure applying portion 512 and a pressed portion 513. The pressed portion 513 is abutted against the pressing lever 41, and the pressure applying portion 512 is abutted against one of the two accumulating members 31 adjacent to the pressing lever 41. When the pressing lever 41 is swung from the first position toward the second position, the pressing lever 41 presses the pressed portion 513 of the actuating member 51 and the pressure applying portion 512 of the actuating member 51 presses the two accumulating members 31.

Specifically, the pressure applying portion 512 is located between the pressed portion 513 and the adjusting mechanism 5. When the adjusting mechanism 5 is in the third position and the pressing lever 41 is swung toward the second position, and before the engaging portion 42 is disengaged from the striking member 2, the pressure applying portion 512 presses the two accumulating members 31 to move in a direction away from the pressing lever 41, one of the two accumulating members 31 adjacent to the staple outlet 11 is disengaged from the striking member 2 and swung in a direction toward the staple outlet 11 (as shown in FIG. 5), and the other of the two accumulating members 31 away from the staple outlet 11 is engaged with the striking member 2 to accumulate force. In this embodiment, a length of one of the two accumulating members 31 adjacent to the staple outlet 11 is shorter than a length of the other of the two accumulating members 31 away from the staple outlet 11 so that one of the accumulating members 31 adjacent to the staple outlet 11 is disengaged from the striking member 2 when the adjusting mechanism 5 is in the third position. Preferably, the two accumulating members 31 are overlapped with each other at their respective ends that adjacent to the adjusting mechanism 5 so that the two accumulating members 31 are stably comovable to accumulate force when the adjusting mechanism 5 is in the fourth position.

In this embodiment, the actuating member 51 penetrates through the two accumulating members 31 and is abutted against an end of a compression spring 6, and another end of the compression spring 6 is abutted against the housing 1, the actuating member 51 has a tendency to move in a direction toward the pressing lever 41, and the pressing lever 41 has a tendency to swing toward the first position so as to return to an original position after stapling.

In summary, only one of the two accumulating members is deformable to accumulate force when the adjusting mechanism is in the third position, and both of the two accumulating members are deformable to accumulate force when the adjusting mechanism is in the fourth position. The striking strength is adjustable by the adjusting mechanism according to various operational requirements without requirement of staple guns with different striking strength, which is convenient to use and low cost.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A staple gun, including:

a housing, including a staple outlet;

a striking member, disposed on the housing and being movable toward or away from the staple outlet;

a force-accumulating assembly, movably disposed on the housing and engaged with the striking member, including two accumulating members;

a driving mechanism, including a pressing lever which is rotatably disposed on the housing and an engaging portion, the pressing lever being swingable between a first position and a second position, the engaging portion and the striking member being engaged with each other when the pressing lever is in the first position, the driving mechanism forcing the force-accumulating assembly to deform and accumulate force when the pressing lever is swinging toward the second position, the engaging portion and the striking member being disengaged from each other and the striking member being driven by the force-accumulating assembly and moved toward the staple outlet when the pressing lever is in the second position;

an adjusting mechanism, disposed on the housing and being movable between a third position and a fourth position, the adjusting mechanism being assembled with the force-accumulating assembly;

wherein when the adjusting mechanism is in the third position, only one of the two accumulating members is engaged and comovable with the striking member; when the adjusting mechanism is moved to the fourth position, the adjusting mechanism drives the force-accumulating assembly to move and both of the two accumulating members are engaged and comovable with the striking member.

2. The staple gun of claim 1, wherein the adjusting mechanism includes an actuating member which is engaged with the two accumulating members, and when the adjusting mechanism is moved from the third position toward the fourth position, the actuating member drives both of the two accumulating members to engage with the striking member.

3. The staple gun of claim 2, wherein the adjusting mechanism includes an adjusting member, the adjusting member and the actuating member are assembled with each other, the adjusting member is disposed on the housing and swingable between the third position and the fourth position, and the adjusting member drives the actuating member to move.

4. The staple gun of claim 2, wherein the housing includes two sliding grooves which are nonparallel with each other, the adjusting member is V-shaped and two opposite sides of the adjusting member respectively have a guiding portion which is slidable within one of the two sliding grooves, an end of the adjusting member protrudes beyond the housing, and the actuating member is rotatably connected with the adjusting member.

5. The staple gun of claim 2, wherein the two accumulating members are overlapped with each other and have respective slots corresponding to each other, the actuating member penetrates through the respective slots of the two accumulating members, an end of the actuating member away from the striking member includes an embedding portion engaged with respective ends of the two accumulating members away from the striking member.

6. The staple gun of claim 5, wherein the actuating member includes a pressure applying portion and a pressed portion, the pressed portion is abutted against the pressing lever, and the pressure applying portion is abutted against one of the two accumulating members adjacent to the pressing lever.

7. The staple gun of claim 6, wherein the pressure applying portion is located between the pressed portion and the adjusting mechanism, when the adjusting mechanism is in the third position and the pressing lever is swung toward the second position, and before the engaging portion is disengaged from the striking member, the pressure applying portion presses the two accumulating members to move in a direction away from the pressing lever, one of the two accumulating members adjacent to the staple outlet is disengaged from the striking member and swung in a direction toward the staple outlet, the other of the two accumulating members away from the staple outlet is engaged with the striking member to accumulate force.

8. The staple gun of claim 6, wherein the actuating member penetrates through the two accumulating members and is abutted against an end of a compression spring, another end of the compression spring is abutted against the housing, the actuating member has a tendency to move in a direction toward the pressing lever, and the pressing lever has a tendency to swing toward the first position.

9. The staple gun of claim 1, wherein a length of one of the two accumulating members adjacent to the staple outlet is shorter than a length of the other of the two accumulating members away from the staple outlet.

10. The staple gun of claim 8, wherein the two accumulating members are overlapped with each other at their respective ends that adjacent to the adjusting mechanism.

* * * * *